US005863877A

United States Patent [19]

Carr et al.

[11] Patent Number: 5,863,877

[45] Date of Patent: Jan. 26, 1999

[54] CARBONATE BUILT CLEANING COMPOSITION CONTAINING ADDED MAGNESIUM

[75] Inventors: Charles D. Carr, Yardley, Pa.; Joseph G. Becker, Martinsville, N.J.; Anthony J. Falotico, Doylestown, Pa.; Steven A. Bolkan, Hopewell, N.J.

[73] Assignee: Church & Dwight Co., Inc., Princeton, N.J.

[21] Appl. No.: 649,988

[22] Filed: May 17, 1996

Related U.S. Application Data

[63] Continuation-in-part of Ser. No. 136,397, Oct. 13, 1993, abandoned.

[51] Int. Cl.[6] ..... C11D 3/07

[52] U.S. Cl. ..... 510/348; 510/351

[58] Field of Search ..... 510/348

[56] References Cited

U.S. PATENT DOCUMENTS

| | | | |
|---|---|---|---|
| 4,265,790 | 5/1981 | Winston et al. | 252/532 |
| 4,368,134 | 1/1983 | Kaeser | 252/140 |
| 4,430,243 | 2/1984 | Bragg | 252/91 |
| 4,464,292 | 8/1984 | Lengyel | 252/532 |
| 4,490,271 | 12/1984 | Spadini et al. | 252/174.23 |
| 4,502,986 | 3/1985 | Robson | 252/526 |
| 4,510,066 | 4/1985 | Saar | 252/140 |
| 4,521,332 | 6/1985 | Milora | 252/527 |
| 4,711,740 | 12/1987 | Carter et al. | 252/174.24 |
| 4,785,060 | 11/1988 | Nagler | 525/444 |
| 4,820,441 | 4/1989 | Evans et al. | 252/174.18 |
| 4,849,125 | 7/1989 | Seiter et al. | 252/109 |
| 5,026,400 | 6/1991 | Holland et al. | 8/137 |
| 5,431,836 | 7/1995 | Carr et al. | 252/174.14 |

*Primary Examiner*—John M. Ford
*Attorney, Agent, or Firm*—Irving Fishman

[57] ABSTRACT

A non-bleaching cleaning composition, e.g. laundry detergent, wherein the solids content comprises at least about 70 wt. % of sodium carbonate, and up to about 12 wt. % of elemental magnesium in the form of a water soluble salt, e.g., magnesium sulfate or magnesium chloride, based on the total weight of the solids composition. Preferably the composition also contains an active surfactant and, when used as a laundry detergent, a polymeric polycarboxylate, e.g., an acrylic acid polymer. Incorporation of magnesium ions in the foregoing cleaning composition containing carbonate ions is intended to minimize negative interactions that will occur between the precipitation of calcium carbonate and the substrate being cleaned, e.g., fabric encrustation when the composition is used as a laundry detergent.

13 Claims, No Drawings

CARBONATE BUILT CLEANING COMPOSITION CONTAINING ADDED MAGNESIUM

CROSS-REFERENCE TO RELATED APPLICATION

This application is a continuation-in-part of application Ser. No. 08/136,397 filed Oct. 13, 1993 now abandoned.

BACKGROUND OF THE INVENTION

1. Field of the Invention

This invention relates to novel cleaning compositions having a high sodium carbonate builder content, the use of which results in reduced calcium carbonate precipitation.

2. Description of Related Art

Cleaning compositions comprising a water-soluble alkaline carbonate are well-known in the art. For example, it is conventional to use such a carbonate as a builder in detergent compositions which supplement and enhance the cleaning effect of an active surfactant present in the composition. Such builders improve the cleaning power of the detergent composition, for instance, by the sequestration or precipitation of hardness causing metal ions such as calcium, peptization of soil agglomerates, reduction of the critical micelle concentration, and neutralization of acid soil, as well as by enhancing various properties of the active detergent, such as its stabilization of solid soil suspensions, solubilization of water-insoluble materials, emulsification of soil particles, and foaming and sudsing characteristics. Other mechanisms by which builders improve the cleaning power of detergent compositions are probably present but are less well understood. Builders are important not only for their effect in improving the cleaning ability of active surfactants in detergent compositions, but also because they allow for a reduction in the amount of the surfactant used in the composition, the surfactant being generally much more costly than the builder.

Two important classes of builders have been widely used in recent years, viz., phosphorus containing salts such as sodium tripolyphosphate (STPP) which are very effective in sequestering calcium and magnesium ions without precipitating them, and the water-soluble alkaline carbonates mentioned previously such as sodium carbonate, which may be used in amounts up to 90 wt. % of the composition and which effectively precipitate the calcium ions. However phosphorus-containing builders have been found to cause a serious problem of eutrophication of lakes, rivers and streams when present in detergent compositions in relatively large amounts, resulting in the passage of laws in several states mandating a drastic reduction in their use. While the use of water-soluble alkaline carbonate builders do not cause eutrophication, they result in the unrelated problem of calcium carbonate precipitation, leading to, for example, fabric encrustation due to the deposition of the calcium carbonate on the fiber surfaces of fabrics which in turn causes fabric to have a stiff hand and gives colored fabrics a faded appearance.

Polymeric polycarboxylates such as polyacrylates are also known in the detergent art as effective sequestering and dispersing agents as well as crystal growth inhibitors. However, such polycarboxylates have limited biodegradability which presents an environmental problem if they are used in relatively large amounts.

The following prior art references may be considered relevant or material to the invention claimed herein.

U.S. Pat. Nos. 4,265,790, issued May 5, 1981 to Winston et al., and 4,464,292, issued Aug. 7, 1984 to Lengyel, disclose detergent compositions comprising an ethoxylated alcohol and an ethoxy sulfate as a combination of nonionic and anionic surfactants, and over 70 wt % of anhydrous sodium carbonate (soda ash) as a detergent builder.

U.S. Pat. Nos. 4,368,134, issued Jan. 11, 1983 to Kaeser, and 4,510,066, issued Apr. 9, 1985 to Saar, each discloses a process for retarding the setting of a miscible and pumpable crutcher slurry intended to be spray dried to base beads for subsequent conversion to a built synthetic organic nonionic detergent composition. In the disclosure of Saar, the base beads must contain a water-softening zeolite, water soluble salts including sodium bicarbonate and sodium carbonate, with the maximum of sodium carbonate being 40% (col. 6, line 41), a swelling bentonite, and 0.5 to 5% of magnesium sulfate to prevent undesirable setting of the crutcher mix. The disclosure of Kaeser is similar to that of Saar except that a swelling bentonite need not be present in his builder, magnesium sulfate and a citric material or magnesium citrate is used to prevent gelation and setting up of the crutcher mix, and a maximum of only 30% of sodium carbonate is present in the crutcher mix (col. 4, line 33).

U.S. Pat. No. 4,430,243, issued Feb. 7, 1984 to Bragg, discloses laundry bleaching and detergent compositions which must contain 5 to 35 wt. % of a peroxygen bleaching agent, 0.05 to 2 wt. % of a catalyst composition for the bleaching agent comprising a specified combination of metal cations, and 5 to 90 wt. % of a detergent builder salt which may be an alkali metal carbonate. The patent also discloses that a magnesium salt in an amount of 0.015 to 0.2 wt. % (expressed as the weight of magnesium) may also be present in the composition to provide additional low temperature stain removal benefits.

U.S. Pat. No. 4,490,271, issued Dec. 25, 1984 to Spadini et al., discloses detergent compositions comprising an active surfactant, up to 80% of a non-phosphorus detergent builder such as a water-soluble carbonate, and a polyacrylate such as a copolymer of acrylic acid with any of various comonomers.

U.S. Pat. No. 4,521,332, issued Jun. 4, 1985 to Milora, discloses highly alkaline liquid cleaning compositions comprising a nonionic surfactant, 10 to 45 wt. % of sodium hydroxide, 0.04 to 4 wt. % of a polyacrylic acid salt, 0 to 15 wt. % of an alkali metal phosphate builder such as STPP, 0.5 to 20 wt. % of a "building agent" such as sodium carbonate, and 6 to 60 wt. % of water.

U.S. Pat. No. 4,711,740, issued Dec. 8, 1987 to Carter et al., discloses detergent compositions comprising a "detergent active" compound, i.e., a surfactant, a detergent builder which is a water-soluble carbonate, e.g. sodium carbonate in an amount of "at least 5% by weight, such as from 10% to 40%, preferably 10% to 30% weight, though an amount up to 75% could possible be used if desired in special products," a water insoluble carbonate, e.g., calcium carbonate (calcite) in an amount of 5 to 60 wt. %, as seed crystals for precipitated calcium carbonate which is thus prevented from being deposited on fabrics; and a copolymer of a carboxylic monomer, e.g., acrylic acid, and a non-carboxylic monomer, such copolymer being present in an amount of 0.1 to 10 wt. % and acting as a colloid stabilizer for the precipitated calcium carbonate. Other detergency builders such as STPP may also be present.

U.S. Pat. Nos. 4,785,060, issued Nov. 15, 1988 to Nagler and 5,026,400, issued Jun. 25, 1991 to Holland et al., each discloses detergent compositions containing a polyethylene terephthalate-polyoxyethylene terephthalate (PET-POET) soil release agent, a builder which may be sodium carbonate and/or sodium bicarbonate, or sodium sesquicarbonate, and magnesium sulfate as a crutching aid. Holland et al. disclose that their composition may contain a maximum of 30% of sodium carbonate but do not mention any specific amount of magnesium sulfate, while Nagler does not disclose any specific percentages of sodium carbonate but specifies that magnesium sulfate may be present in an amount of 0.5 to 3%.

U.S. Pat. No. 4,820,441, issued Apr. 11, 1989 to Evans et al., discloses granular detergent compositions which may contain in addition to an active surfactant, 5 to 75 wt. % of a crystal growth modified, carbonate-based structurant salt, 0.1 to 20 wt. % of a polymeric polycarboxylate as crystal growth modifier based on the weight of the structurant salt, and 0 to 40 wt. % of STPP. The structurant salt may contain sodium sulfate as well as sodium carbonate and sodium bicarbonate, and the two tables under the heading "PRODUCTS OF THE INVENTION" in columns 8 and 9 of the patent show a maximum of 40 wt. % of sodium carbonate in the final product composition.

U.S. Pat. No. 4,849,125, issued Jul. 18, 1989 to Seiter et al., discloses phosphate-reduced, granular, free-flowing detergent compositions comprising 4 to 40 wt. % of a nonionic surfactant, 3 to 20 wt. % of an anionic surfactant, 0.5 to 15 wt. % of a homopolymeric or copolymeric carboxylic acid or salt, 0 to 20 wt. % of STPP, and, optionally, up to 15 or 20 wt. % of sodium carbonate.

M. M. Reddy and K. K. Wang, "Crystallization of Calcium Carbonate in the Presence of Metal Ions", Journal of Crystal Growth 50 (1980) 470–480, discusses the influence of magnesium ions in solution on the growth of pure calcite from a stable supersaturated solution onto a well-characterized pure calcite surface.

SUMMARY OF THE INVENTION

In accordance with this invention, a non-bleaching cleaning composition is provided wherein the solids content comprises at least about 70 wt. % of sodium carbonate as at least part of the builder and about 0.1 to about 12 wt. %, based on the weight of total solids in the composition, of elemental magnesium, in the form of a water soluble salt. Preferably, the composition also contains an active surfactant.

Incorporation of magnesium ions in the foregoing cleaning composition containing carbonate ions is intended to minimize negative interactions that will occur between the precipitation of calcium carbonate and the substrate being cleaned. For example, when used as a laundry detergent, the composition is capable of providing excellent cleaning and whitening of fabrics while avoiding the problem of eutrophication which occurs when a substantial amount of a phosphorous containing builder such as STPP is present in the composition, and while minimizing the problem of fabric encrustation often present when the composition contains a large amount of carbonate builder.

The reduction in the amount of calcium carbonate precipitation, and particularly fabric encrustation obtained when using the composition of this invention as a laundry detergent is apparently due to an effect of magnesium ions at certain concentrations in inhibiting the precipitation of calcium carbonate on the substrate being cleaned, e.g., fabric surfaces, for a limited period of time. This is a surprising effect since magnesium is commonly considered to be equal to calcium as a hardness ingredient of water.

DETAILED DESCRIPTION OF THE INVENTION

The builder of the detergent composition comprises at least about 70 wt. % of sodium carbonate and optionally one or more other water-soluble alkaline carbonates, for example, another alkali metal carbonate, or an alkali metal bicarbonate or sesquicarbonate such as potassium carbonate and/or sodium or potassium bicarbonate or sesquicarbonate. A preferred builder is a combination of sodium carbonate and sodium bicarbonate. The total water-soluble carbonate, bicarbonate and/or sesquicarbonate may be present in an amount, for example, of about 70 to 90 wt. %, preferably about 75 to 85 wt. %. If a combination of sodium carbonate and bicarbonate is used as the water-soluble carbonate, then the sodium carbonate is preferably used in an amount of about 75 to 80 wt. % and the sodium bicarbonate, in an amount of about 0.1 to 15 wt. %.

Water soluble magnesium salts which may be used in preparing the detergent compositions of this invention are, for example, magnesium sulfate, magnesium chloride, magnesium nitrate, magnesium acetate, and dibasic magnesium citrate. Sufficient magnesium salt is added to the composition such that elemental magnesium is present in an amount, for example, of up to about 12 wt. % based on the total solids. In general, the wash water before the addition of cleaning composition contains some calcium hardness. For example, about 10 to 350 ppm of calcium hardness expressed as $CaCO_3$ and a Ca/Mg molar ratio of, for example, about 5/1 to 2/1 may be present, in which case the elemental magnesium in the cleaning composition should be, for example, about 0.1 to 12 wt. %, preferably about 1 to 5 wt. % based on the weight of total solids in the composition. An amount of magnesium within the foregoing ranges may add, for example about 7 to 800 ppm, preferably about 65 to 340 ppm, of magnesium expressed as $CaCO_3$ to the wash water, based on the weight of the wash water, so that the final wash liquor contains after the addition of cleaning composition, for example, about 15 to 1160 ppm, preferably about 75 to 690 ppm of magnesium expressed as $CaCO_3$. This has the effect of decreasing the Ca/Mg molar ratio in the wash liquor by a number of units in the range of about 4/1 to 1/4 units, preferably about 1/1 to 1/2 units, so that the Ca/Mg molar ratio in the wash liquor after the addition of the cleaning composition is in the range, for example, of about 2/1 to about 1/3, preferably about 1/1 to about 1/2, at which the beneficial effect of magnesium in reducing encrustation is most evident. If the calcium hardness and magnesium content of the wash water before the addition of cleaning composition is known to be substantially outside the stated ranges, the broad and preferred ranges of the amount of elemental magnesium in the detergent composition may be adjusted so that the amount of calcium and magnesium in the wash liquor falls within the foregoing ranges after the addition of cleaning composition. The foregoing ranges of amount of magnesium in the detergent composition and the calcium and magnesium content of the wash liquor before and after the addition of detergent assume normal and accepted use of a detergent wherein the wash liquor contains about 0.1 to 1 wt. % of detergent solids during the washing operation. The term "expressed as $CaCO_3$", as applied to amounts of calcium or magnesium in this paragraph and hereinafter, means the weight in parts per million of the number of moles of $CaCO_3$ equal to the number of moles of calcium or magnesium being characterized.

Preferably, the cleaning composition of this invention contains an active surfactant component, e.g., one or more of many suitable synthetic detergent active compounds which are commercially available and described in the literature, for example, in "Surface Active Agents and Detergents", Volumes 1 and 2 by Schwartz, Perry and Berch. Several detergents and active surfactants are also described in, for example, U.S. Pat. Nos. 3,957,695; 3,865,754; 3,932,316 and 4,009,114. In general, the composition may include a synthetic anionic, nonionic, amphoteric or zwitterionic detergent active compound, or mixtures of two or more of such compounds.

More preferably, the laundry detergent compositions of this invention contain at least one anionic or nonionic surfactant, and, most preferably, a mixture of the two types of surfactant.

The contemplated water soluble anionic detergent surfactants are the alkali metal (such as sodium and potassium) salts of the higher linear alkyl benzene sulfonates and the alkali metal salts of sulfated ethoxylated and unethoxylated fatty alcohols, and ethoxylated alkyl phenols. The particular salt will be suitably selected depending upon the particular formulation and the proportions therein.

The sodium alkybenzenesulfonate surfactant (LAS), if used in the composition of the present invention, preferably has a straight chain alkyl radical of average length of about 11 to 13 carbon atoms.

Specific sulfated surfactants which can be used in the compositions of the present invention include sulfated ethoxylated and unethoxylated fatty alcohols, preferably linear primary or secondary monohydric alcohols with $C_{10}$–$C_{18}$, preferably $C_{12}$–$C_{16}$, alkyl groups and, if ethoxylated, on average about 1–15, preferably 3–12 moles of ethylene oxide (EO) per mole of alcohol, and sulfated ethoxylated alkylphenols with $C_8$–$C_{16}$ alkyl groups, preferably $C_8$–$C_9$ alkyl groups, and on average from 4–12 moles of EO per mole of alkyl phenol.

The preferred class of anionic surfactants are the sulfated ethoxylated linear alcohols, such as the $C_{12}$–$C_{16}$ alcohols ethoxylated with an average of from about 1 to about 12 moles of ethylene oxide per mole of alcohol. A most preferred sulfated ethoxylated detergent is made by sulfating a $C_{12}$–$C_{15}$ alcohol ethoxylated with 3 moles of ethylene oxide per mole of alcohol.

Specific nonionic surfactants which can be used in the compositions of the present invention include ethoxylated fatty alcohols, preferably linear primary or secondary monohydric alcohols with $C_{10}$–$C_{18}$, preferably $C_{12}$–$C_{16}$, alkyl groups and on average about 1–15, preferably 3–12 moles of ethylene oxide (EO) per mole of alcohol, and ethoxylated alkylphenols with $C_8$–$C_{16}$ alkyl groups, preferably $C_8$–$C_9$ alkyl groups, and on average about 4–12 moles of EO per mole of alkyl phenol.

The preferred class of nonionic surfactants are the ethoxylated linear alcohols, such as the $C_{12}$–$C_{16}$ alcohols ethoxylated with an average of from about 1 to about 12 moles of ethylene oxide per mole of alcohol. A most preferred nonionic detergent is a $C_{12}$–$C_{15}$ alcohol ethoxylated with 3 moles of ethylene oxide per mole of alcohol.

Mixtures of the foregoing synthetic detergent type of surfactants, e.g., of anionic and nonionic, or of different specific anionic or nonionic surfactants, may be used to modify the detergency, sudsing characteristics, and other properties of the composition. For example, a mixture of different fatty alcohols of 12 to 15 carbon atoms may be ethoxylated, directly sulfated, or sulfated after ethoxylation, a fatty alcohol may be partially ethoxylated and sulfated, or an ethoxylated fatty acid may be partially sulfated to yield a mixture of different anionic and nonionic surfactants or different specific anionic or nonionic surfactants.

The total active surfactant in the composition may be in the range, for example, of about 5 to 15 wt. % preferably about 8 to 12 wt. % based on the weight of solids in the composition. If, as preferred, the active surfactant consists of a combination of anionic and nonionic surfactants, then the anionic surfactant is present in the range, for example, of about 4 to 14 wt. %, preferably about 5 to 10 wt. %, and the nonionic surfactant is present in the range, for example, of about 2 to 8 wt. %, preferably about 3 to 5 wt. %, all based on the weight of total solids.

If used as a laundry detergent, it is preferred that the cleaning composition of this invention contain a small amount of a polymeric polycarboxylate which is known to act as a soil antiredeposition agent. The polymeric polycarboxylate may be, for example, a homopolymer or copolymer (composed of two or more co-monomers) of an alpha, beta-ethylenically unsaturated acid monomer such as acrylic acid, methacrylic acid, a diacid such as maleic acid, itaconic acid, fumaric acid, mesoconic acid, citraconic acid and the like, a monoester of a diacid with an alkanol, e.g., having 1–8 carbon atoms, and mixtures thereof. When the polymeric polycarboxylate is a copolymer, it may be a copolymer of more than one of the foregoing unsaturated acid monomers, e.g., acrylic acid and maleic acid, or a copolymer of at least one of such unsaturated acid monomers with at least one non-carboxylic alpha, beta-ethylenically unsaturated monomer which may be either relatively non-polar such as styrene or an olefinic monomer, such as ethylene, propylene or butene-1, or which has a polar functional group such as vinyl acetate, vinyl chloride, vinyl alcohol, alkyl acrylates, vinyl pyridine, vinyl pyrrolidone, or an amide of one of the delineated unsaturated acid monomers, such as acrylamide or methacrylamide. Certain of the foregoing copolymers may be prepared by aftertreating a homopolymer or a different copolymer, e.g., copolymers of acrylic acid and acrylamide by partially hydrolyzing a polyacrylamide.

Copolymers of at least one unsaturated carboxylic acid monomer with at least one non-carboxylic comonomer should contain at least about 50 mol % of polymerized carboxylic acid monomer.

The polymeric polycarboxylate should have a number average molecular weight of, for example about 1000 to 10,000, preferably about 2000 to 5000. To ensure substantial water solubility, the polymeric polycarboxylate is completely or partially neutralized, e.g., with alkali metal ions, preferably sodium ions, or with magnesium ions supplied by magnesium oxide or hydroxide which thus acts as the source of the added magnesium.

The polymeric polycarboxylate, if used, is present in the detergent composition in an amount, for example, of about 0.05 to 5 wt. %, preferably about 0.1 to 2 wt. %, based on the weight of the total solids.

In addition to its usual function as a soil antiredeposition agent, the polymeric polycarboxylate has the unexpected effect in this invention of enhancing the reduction of encrustation caused by the added magnesium. Thus, in the absence of polymeric polycarboxylate, the added magnesium of this invention has the effect of reducing fabric encrustation for wash cycle times of up to about 12 minutes when the total calcium plus magnesium hardness of the wash water is at least about 50 ppm expressed as $CaCO_3$; at wash cycle times appreciably above about 20 minutes, the addition of magnesium may increase encrustation. However, in the presence of a polymeric polycarboxylate, the addition of magnesium reduces encrustation at all practical wash cycle times and to a degree considerably greater than the added magnesium alone, or of the polymeric carboxylate alone.

The cleaning composition of this invention is preferably in the form of a dry-appearing powder, in which case the weight percentages of the various components mentioned previously are approximately based on the weight of the total composition. However, such dry appearing powder generally contains water in an amount, for example, of about 1 to 12 wt. %, preferably about 2 to 10 wt. % based on the weight of the total composition. Alternatively, however, the cleaning composition may be in the form of a liquid, e.g., a concentrated aqueous solution of the cleaning components containing, for example, about 0.5 to 30 wt. % of cleaning solids.

If used as a laundry detergent, the cleaning compositions of this invention may also contain various adjuvants common to detergent formulations such as brighteners, enzymes, carboxymethylcellulose, perfumes, and dyes. The term "non-bleaching" used to characterize the compositions of this invention is intended to mean that the composition does not contain any conventional bleaching agent as understood by those skilled in the art, e.g., any of various chlorine-containing compounds such as sodium hypochlorite, or peroxide generating persalts.

The following examples further illustrate the invention. In the examples involving values of turbidity, a test for turbidity was used, the results of which correlate with the fabric encrustation caused by the employment of a carbonate built detergent composition, with lower turbidity indicating lower fabric encrustation. The test is carried out utilizing a calcium hardness solution containing a predetermined amount of calcium chloride dihydrate dissolved in deionized water, and a detergent solution in deionized water of a predetermined amount of carbonate built detergent composition to be tested containing either no magnesium as a control or a predetermined amount of a soluble magnesium salt such as magnesium sulfate or magnesium chloride. The concentrations of calcium chloride dihydrate in the calcium hardness solution and of detergent composition and magnesium salt if used in the detergent solution are controlled so that when predetermined amounts of the two solutions are mixed together with a predetermined additional amount of ionized water, an overall solution containing about 0.162 wt. % of detergent composition, a desired calcium hardness expressed as ppm of calcium carbonate, and a desired amount of magnesium as ppm of $CaCO_3$ and level of Ca/Mg molar ratio are obtained. The predetermined amounts of the two solutions and the deionized water to be added, are preheated to 35° C. and combined with stirring simultaneously with the starting of a timer. Stirring of the combined solution is continued and the turbidity of the solution is measured with a Hach Turbidimeter in National Turbidity Units (NTU's) at certain set time intervals, e.g., 5, 10, 15 and 20 min.

EXAMPLES 1 AND 2 AND COMPARATIVE EXAMPLES A AND B

These examples illustrate the effect in reduction of turbidity of adding magnesium to soda ash in the absence and presence of an active surfactant. In Comparative Example A, a control detergent solution of soda ash with no active surfactant, was combined with a calcium chloride hardness solution such that the combined solution contained 100 ppm of calcium expressed as $CaCO_3$, and the turbidity was determined after 10 and 20 min. In Example 1, the procedure of Comparative Example A was followed except that the detergent solution contained dissolved magnesium chloride in addition to the soda ash such that the combined solution contained 100 ppm of magnesium expressed as $CaCO_3$ and the Ca/Mg molar ratio was 1/1. In Comparative Example B and Example 2, the procedure of Comparative Example A and Example 1 was followed respectively, except that in addition to sodium carbonate and magnesium salt, the detergent solution contained per 80 parts of sodium carbonate an active surfactant consisting of 6.0 parts of the sodium salt of a sulfated $C_{12}$–$C_{15}$ alcohol (anionic surfactant) and 3.2 parts of a $C_{12}$–$C_{15}$ alcohol ethoxylated with 3 moles of ethylene oxide per mole of alcohol (nonionic surfactant). The turbidities in NTU's of the combined solutions of these four examples after 10 and 20 min. are shown in Table I.

TABLE I

| | Turbidity (NTU) | |
|---|---|---|
| Example | 10 min. | 20 min. |
| A | 85 | 83 |
| 1 | 51 | 93 |
| B | 107 | 99 |
| 2 | 65 | 113 |

The results of Table I indicate that the addition of magnesium yields an advantage in reduction of turbidity due to precipitated calcium carbonate from a solution of sodium carbonate with no surfactant (Example 1 vs. Comparative Example A) or with surfactant (Example 2 vs. Comparative Example B). Although these results also indicate that the presence of an active surfactant results in higher turbidity than when no surfactant is utilized, the presence of surfactant is often considered necessary to obtain a sufficiently high cleaning performance from the composition.

EXAMPLE 3

This example illustrates the reductions in turbidity obtained at a calcium hardness of 100 ppm expressed as $CaCO_3$ and with varying amounts of Mg present and Ca/Mg molar ratio obtained by utilizing different amounts of magnesium salt in a carbonate-built detergent composition.

The procedure of Example 2 was followed utilizing 80 parts of sodium carbonate, 0.5 part of sodium bicarbonate, the types and amounts of surfactant shown in Example 2, and different amounts of magnesium chloride in the detergent solution together with the sodium carbonate and bicarbonate and active surfactant. The turbidities obtained at 10 and 20 min. with a calcium hardness of 100 ppm as $CaCO_3$ and varying Ca/Mg molar ratios are shown in Table II.

TABLE II

| Mg present, | Ca/Mg | Turbidity (NTU) | |
|---|---|---|---|
| ppm as $CaCO_3$ | molar ratio | 10 min | 20 min |
| 0 | — | 115 | 115 |
| 20 | 5/1 | 112 | 122 |
| 40 | 1/0.4 | 111 | 122 |
| 50 | 2/1 | 114 | 124 |
| 60 | 1/0.6 | 106 | 135 |
| 80 | 1/0.8 | 83 | 126 |
| 100 | 1/1 | 11 | 95 |
| 120 | 1/1.2 | 10 | 12 |
| 140 | 1/1.4 | 15 | 17 |
| 160 | 1/1.6 | 60 | 126 |

TABLE II-continued

| Mg present, ppm as $CaCO_3$ | Ca/Mg molar ratio | Turbidity (NTU) 10 min | Turbidity (NTU) 20 min |
|---|---|---|---|
| 180 | 1/1.8 | 64 | 135 |
| 200 | 1/2 | 47 | 133 |

The results of Table II indicate that at a calcium hardness of 100 ppm, the turbidity is decreased by the presence of 20 to 200 ppm of Mg expressed as $CaCO_3$ corresponding to a Ca/Mg molar ratio of 5/1 to 1/2 after 10 minutes of contact of the calcium hardness solution with the detergent solution, while the turbidity is decreased by the presence of 100 to 140 ppm of Mg corresponding to a Ca/Mg molar ratio of from about 1/1 to 1/1.4 after 20 min. of contact.

EXAMPLE 4

This example is similar to Example 3 except that the calcium hardness was 150 rather than 100 ppm of calcium as $CaCO_3$. The results are shown in Table III.

TABLE III

| Mg present, ppm as $CaCO_3$ | Ca/Mg molar ratio | Turbidity (NTU) 10 min | Turbidity (NTU) 20 min |
|---|---|---|---|
| 0 | — | 192 | — |
| 50 | 3/1 | 157 | 176 |
| 75 | 2/1 | 159 | 172 |
| 100 | 1.5/1 | 128 | 170 |
| 125 | 1.2/1 | 26 | 138 |
| 150 | 1/1 | 31 | 69 |
| 175 | 1.5/1.75 | 20 | 109 |
| 200 | 1.5/2 | 86 | 177 |

The results of Table III show that at 150 ppm of Ca, the turbidity is decreased by the presence of 50 to 200 ppm of Mg corresponding to a Ca/Mg ratio of from above 3/1 to 1.5/2 after 10 min. of contact between the calcium hardness solution and the detergent solution, while after 20 min. of contact, the turbidity is decreased at a Ca/Mg ratio of from 3/1 to 1.5/1.75.

EXAMPLE 5

This example illustrates the effect of adding magnesium at different levels of calcium hardness to keep the Ca/Mg ratio at a constant level of 1/1.2.

The procedure of Examples 3 and 4 was followed except that the calcium hardness was varied between 100 and 300 ppm as $CaCO_3$ and the amount of magnesium present was varied between 120 and 360 ppm as $CaCO_3$ by addition of magnesium sulfate, with the specific amount in each case adjusted so that the Ca/Mg molar ratio was constant at 1/1.2. At each level of calcium hardness, turbidity measurements were taken with the added magnesium and without any magnesium present. The results are shown in Table IV.

TABLE IV

| Ca Hardness, ppm as $CaCO_3$ | Mg present, ppm as $CaCO_3$ | Turbidity (NTU) with Mg | Turbidity (NTU) No Mg |
|---|---|---|---|
| 100 | 120 | 10 | 115 |
| 150 | 175 | 20 | 192 |

TABLE IV-continued

| Ca Hardness, ppm as $CaCO_3$ | Mg present, ppm as $CaCO_3$ | Turbidity (NTU) with Mg | Turbidity (NTU) No Mg |
|---|---|---|---|
| 200 | 240 | 63 | 186 |
| 250 | 300 | 185 | 254 |
| 300 | 360 | 236 | 373 |

The results show that at all levels of calcium hardness, the addition of magnesium necessary to obtain a Ca/Mg molar ratio of 1/1.2 reduced the turbidity significantly from the level when no magnesium was added.

EXAMPLE 6

This example illustrates the effect of the presence of various amounts of added magnesium in a carbonate built detergent composition in reducing fabric encrustation at the relatively short wash cycle time of 5 minutes.

Three detergent compositions were prepared consisting of soda ash of the amount and composition shown in Comparative Example A, surfactants of the composition and amount shown in Comparative Example B and magnesium chloride in an amount such that when washing tests were carried out with wash water containing 150 ppm of calcium as $CaCO_3$ as described hereinafter, the Ca/Mg molar ratio was 2/1, 1/1 and 1/2 respectively. These detergent compositions were tested for fabric encrustation by repeated washing of cotton fabric at 35° C. In carrying out the test, four 25.4 cm.×25.4 cm., 100% black cotton fabric swatches along with 0.907 kg. of ballast are washed for 5 min. with 113.4 g of the detergent composition being tested such that the wash liquor contained about 0.162 wt. % of detergent. After washing is completed, 2.00–4.00 g of the calcium carbonate encrusted fabrics are extracted in 100 ml. of 0.2N hydrochloric acid for 30 min. and a 2.0–4.0 ml. aliquot is analyzed for hardness by the EDTA titration method. Encrustation is expressed as mg. calcium carbonate per gram of fabric.

Table V indicates the fabric encrustation after five washing machine cycles of use.

TABLE V

| Ca/Mg Molar Ratio | Fabric Encrustation |
|---|---|
| 2/1 | 71 |
| 1/1 | 25 |
| 1/2 | 13 |

The results of Table V show the marked effect of adding magnesium to decrease the Ca/Mg molar ratio in the wash liquor from 2/1 to 1/2, in reducing the fabric encrustation at a wash cycle time of 5 minutes.

EXAMPLES 7 AND 8 AND COMPARATIVE EXAMPLES C AND D

These examples illustrate the effect on fabric encrustation of adding magnesium to the system at two levels of water hardness, using a 12 minute wash cycle time.

The procedure of Example 6 was followed except that no magnesium salt was present in the detergent composition in Comparative Examples C and D and magnesium sulfate comprised about 7 wt. % of the detergent composition in Examples 7 and 8, and the total wash water hardness (Ca+Mg, Ca/Mg molar ratio=2/1) before the addition of detergent was 250 ppm as $CaCO_3$ in Comparative Example C and Example 7 and 100 ppm in Comparative Example D and Example 8. The addition of $MgSO_4$ in Examples 7 and 8 resulted in an increase of about 95 ppm of Mg expressed as $CaCO_3$ in the wash liquor such that the Ca/Mg molar ratio after the addition of the $MgSO_4$ was close to 1/1 in Example 7 and close to 1/2 in Example 8. The results of the fabric encrustation determinations as mg $CaCO_3$ per gram of fabric after five 12 min. washing machine cycles of use are shown in Table VI.

TABLE VI

| Example | Water Hardness ppm | $MgSO_4$ wt. % | Fabric Encrustation |
|---|---|---|---|
| C | 250 | 0 | 103 |
| 7 | 250 | 7 | 99 |
| D | 100 | 0 | 28 |
| 8 | 100 | 7 | 27 |

The results of Table VI indicate that at total water hardnesses of 100 and 250 ppm, and a wash cycle time of 12 minutes, fabric encrustation was slightly lower when magnesium was present in the detergent than when no magnesium was present. As shown by the results of Table V in Example 6 where the wash cycle time was 5 minutes, the fabric encrustation is likely to be much lower with the addition of magnesium when the wash cycle time is below 12 minutes.

EXAMPLE 9 AND COMPARATIVE EXAMPLE E

These examples illustrate that the reduction of encrustation accomplished by the addition of magnesium to a detergent composition can be accomplished and still provide a good cleaning function when the Ca/Mg molar ratio is reduced from a value of 2/1 typical for natural waters to 1/2. Using the detergent composition comprising sodium carbonate, sodium bicarbonate and surfactant as described in Example 3 and controlling the system so that the wash liquor contained 100 ppm of calcium hardness as $CaCO_3$ and a Ca/Mg molar ratio of 2/1 as is typical for naturally occurring waters as a control (Comparative Example E), or 1/2 which is brought about by adding a somewhat soluble magnesium compound such as $MgCl_2$ or $MgSO_4$ to the detergent bringing the total Ca+Mg hardness to 200 ppm, (Example 9), various swatches of cotton and poly/cotton (a blend of 65 wt. % cotton and 35 wt. % polyester) soiled or stained with various substances, were washed at 35° C. using a 12 minute wash cycle time. Ten replicate soiled or stained swatches were used for each determination. Reflectances of the clean unsoiled samples, the soiled or stained samples and the washed samples after six cycles of washing were measured using the Gardner 2000 colorimeter and conventional spectral software, and the percent soil or stain removal was calculated from the calorimeter measurements. The average percent soil removal for the various types of soiled samples are shown in Table VII while the percent stain removals from the stained samples are shown in Table VIII.

TABLE VII

| Soiled Sample | Percent Soil Removal: Comp. Example E 2 Ca/1 Mg Molar Ratio | Example 9 1 Ca/2 Mg Molar Ratio |
|---|---|---|
| Dust Sebum on Poly/Cotton | 80 | 80 |
| Clay on Poly/Cotton | 81 | 83 |
| STD (Oil and Clay) on Cotton | 41 | 40 |
| Dust Sebum on Cotton | 45 | 45 |
| Clay on Cotton | 55 | 56 |

TABLE VIII

| Stained Sample | Percent Stain Removal: Comp. Example E 2 Ca/Mg Molar Ratio | Example 9 1 Ca/2 Mg Molar Ratio |
|---|---|---|
| Coffee on Cotton | 48 | 46 |
| Grass on Cotton | 54 | 55 |
| Ketchup on Cotton | 85 | 86 |
| Beef Gravy on Cotton | 70 | 70 |

Although it was expected that changing the Ca/Mg molar ratio from 2/1 to 1/2 would reduce detergency somewhat because the added magnesium inhibits the precipitation of calcium, the actual effect on the percent soil and stain removal is shown by the results of Tables VII and VIII to be non-existent. In contrast, the results of Example 3 (Table II) and Example 6 (Table V) show that turbidity at 10 min. contact time and encrustation at a 5 min. wash cycle are substantially decreased when the Ca/Mg molar ratio is reduced from 2/1 to 1/2.

The following examples illustrate the enhancement of the effect of reducing turbidity and encrustation with added magnesium by the further addition of a polymeric polycarboxylate, and, in several examples, the synergistic effect of magnesium and a polymeric polycarboxylate in causing such reduction.

EXAMPLES 10 AND 11 AND COMPARATIVE EXAMPLES F AND G

The procedure of Example 3 was followed except that no magnesium was present in the wash liquor in Comparative Examples F and G, 100 ppm of magnesium expressed as $CaCO_3$ was present in Examples 10 and 11 such that the Ca/Mg molar ratio was 1/1, no polymeric polycarboxylate ("polymer") was present in Comparative Example F and Example 10, and 1.5 wt. % of a polymer based on the weight of the detergent composition was present in Comparative Example G and Example 11, such polymer being a terpolymer of about 49.5 wt. % acrylic acid, about 49.5 wt. % maleic acid, and about 1 wt. % of acrylamide and having a number average molecular weight of about 3000. The polymer was completely neutralized on contact with the sodium carbonate of the detergent formulation. The results are shown in Table IX.

TABLE IX

| Example | Polymer wt. % | Mg, ppm as $CaCO_3$ | Turbidity (NTU) 10 min. | 20 min. |
|---|---|---|---|---|
| F | 0 | 0 | 113 | 118 |
| 10 | 0 | 100 | 9 | 77 |
| G | 1.5 | 0 | 30 | 31 |
| 11 | 1.5 | 100 | 0.4 | 0.5 |

The results of Table IX show that not only do magnesium and the polymeric polycarboxylate each separately reduce turbidity substantially after 10 and 20 min., but that the presence of both magnesium and polymeric polycarboxylate reduce the turbidity still further to a degree which could not have been predicted from the separate effects of the magnesium and polymer, i.e., the two additives together result in a synergistic effect.

EXAMPLE 12

The procedure of Example 4 (Table III) was followed utilizing 150 ppm of calcium and varying amounts of magnesium except that 1.5 wt. % of the polymer utilized in Example 11 was present in each wash liquor. The results are shown in Table X.

TABLE X

| Mg, ppm (as CaCO3) | Ca/Mg, Molar Ratio | Turbidity (NTU) 10 min. | 20 min. |
|---|---|---|---|
| 0 | — | 182 | 193 |
| 50 | 3/1 | 193 | 205 |
| 75 | 2/1 | 93 | 117 |
| 100 | 1.5/1 | 1 | 22 |
| 125 | 1.2/1 | 4 | 3 |
| 150 | 1.0/1 | 9 | 8 |
| 175 | 1/1.2 | 14 | 15 |
| 200 | 1/1.3 | 20 | 24 |

The results of Table X as compared with those of Table II indicate that the presence of both magnesium and polymer exerts a strong synergistic effect on the reduction of turbidity caused by the interaction of calcium hardness and a carbonate built detergent composition at 10 and 20 min. contact time.

EXAMPLE 13 AND COMPARATIVE EXAMPLE H

The procedure of Example 7 and Comparative Example C were followed respectively except that the detergent formulation also included 1.35 wt. % of Rohm & Haas 445 polymer, which is a polyacrylic acid having a number average molecular weight of about 4500. The polymer becomes completely neutralized on contact with the sodium carbonate of the formulation. In Comaprative Example H wherein the detergent formulation contained 1.35 wt. % of polymer and no magnesium, the encrustation was 53 mg of $CaCO_3$ per gram of fabric, while in Example 13 wherein the formulation contained 8 grams of $MgSO_4$ and 1.35 wt. % of polymer, the fabric encrustation was 15 mg $CaCO_3$ per gram of fabric. The latter value indicates a synergistic effect of magnesium and polymer used together since the difference between such value and that of 103 obtained when neither magnesium nor polymer was present in the formulation (Comparative Example C) is greater than would be predicted from the value of 99 obtained when magnesium but no polymer was present in the formulation (Example 7), and the value of 53 obtained when polymer but no magnesium was present (Comparative Example H).

EXAMPLES 14 TO 17 AND COMPARATIVE EXAMPLE I

These examples illustrate that the benefit in reduced turbidity of including both magnesium and a polymeric polycarboxylate in a carbonate built detergent can be obtained by using a basic magnesium compound to neutralize the acid as well as by separate addition of a magnesium compound and polymer.

The procedure of Example 3 was followed except that the detergent formulation included, in addition to sodium carbonate, sodium bicarbonate and surfactant as described in Example 3, 1.35 wt. % of a neutralized Rohm & Haas 445 polymer as described in Example 13. The combined solution measured for turbidity contained, exclusive of any magnesium used to neutralize the polymer or added as equivalent to the neutralized base, 150 ppm of calcium and 75 ppm of magnesium each expressed as $CaCO_3$ (Ca/Mg molar ratio= 2/1) which is typical of the natural hardness of water.

In Comparative Example I, the polymer was neutralized with sodium carbonate.

In Example 14, the polymer was neutralized neat with MgO.

In Example 15, the polymer was diluted with water and neutralized with MgO.

In Example 16, the polymer was neutralized with NaOH followed by "ion exchange" with a stoichiometric amount of $MgSO_4$.

In Example 17, the polymer was neutralized with sodium carbonate and an equivalent amount of $MgSO_4$ added to the system. The turbidities of the sample after 5, 10 and 15 minutes are shown in Table XI.

TABLE XI

| Example | Turbidity (NTU) 5 min. | 10 min. | 15 min. |
|---|---|---|---|
| I | 3 | 40 | 85 |
| 14 | 4 | 14 | 48 |
| 15 | 3 | 5 | 58 |
| 16 | 1 | 2 | 55 |
| 17 | 1 | 1 | 27 |

The results of Table XI indicate that at a contact time between detergent composition and wash water above a point between five and ten minutes, the turbidity is reduced by the presence of magnesium ions whether added for the neutralization of the polymer (Examples 14, 15 and 16) or separately (Example 17). The reduction in turbidity at 10 and 15 minutes in Examples 14 to 17 is obtained despite the fact that the addition of magnesium resulted in a relatively slight increase of magnesium in the wash liquor, i.e., only 15 ppm expressed as $CaCO_3$, for a reduction of the Ca/Mg molar ratio of from 150/75 (2/1) to 150/90.

EXAMPLES 18 TO 27 AND COMPARATIVE EXAMPLES J AND K

These examples illustrate the effect of carrying out 5 cycle encrustation tests using varying amounts of Rohm and Haas 445 polymer and magnesium sulfate in the detergent composition at a constant hardness of wash water.

The tests were carried out using the procedure described in Examples 7 and 13, under the following constant conditions: total wash water hardness (Ca+Mg, Ca/Mg molar ratio of 2/1)=250 ppm; wash temperature=35° C.; and wash cycle=12 min. The content of Rohm and Haas 445 polymer ("polymer") and magnesium sulfate ("$MgSO_4$") as weight percent of the detergent composition and fabric encrustation as mg. of calcium carbonate per gram of fabric obtained in each example are shown in Table XII.

TABLE XII

| Example | Polymer, wt. % | $MgSO_4$, wt. % | Fabric Encrustation, mg $CaCO_3$/g fabric |
|---|---|---|---|
| J | 0 | 0 | 97 |
| K | 1.00 | 0 | 85 |
| 18 | 0 | 7 | 99 |
| 19 | 1.00 | 7 | 28 |
| 20 | 1.00 | 3.5 | 73 |
| 21 | 1.00 | 2.0 | 89 |
| 22 | 1.35 | 7 | 26 |
| 23 | 1.35 | 5 | 43 |
| 24 | 1.35 | 3 | 57 |
| 25 | 0.92 | 7 | 23 |
| 26 | 0.62 | 7 | 20 |
| 27 | 0.31 | 7 | 32 |

The results of Table XII indicate that at a wash cycle time of 12 min. and a polymer content of 1.00 wt. % the synergestic effect of magnesium and polymer on fabric encrustation is most pronounced when the $MgSO_4$ content is at least about 3.5 wt. % and increases as the $MgSO_4$ content is increased. However, at a $MgSO_4$ content of 7 wt. %, a pronounced synergistic effect can be obtained with a relatively low polymer content, e.g. 0.3 wt. %, which is comparable to that obtained at a polymer content of 1.35 wt. %.

We claim:

1. In a non-bleaching cleaning composition wherein the solids comprise at least about 70 wt. % of sodium carbonate, the improvement comprising the presence in the composition of about 1 to about 12 wt. % of elemental magnesium in the form of a water soluble salt, based on the total weight of the solids in the composition.

2. The composition of claim 1 wherein said solids comprise about 75 to 80 wt. % of sodium carbonate and in addition about 0.1 to 15 wt. % of sodium bicarbonate, based on the total weight of solids.

3. The composition of claim 1 wherein said elemental magnesium comprises about 1 to 5 wt. % of the total solids.

4. The composition of claim 1 wherein said magnesium salt is magnesium sulfate.

5. The composition of claim 1 wherein said magnesium salt is magnesium chloride.

6. The composition of claim 1 wherein said magnesium salt is magnesium nitrate.

7. The composition of claim 1 wherein said magnesium salt is magnesium acetate.

8. The composition of claim 1 wherein said magnesium salt is dibasic magnesium citrate.

9. In a non-bleaching cleaning composition wherein the solids comprise at least about 70 wt. % of sodium carbonate, and an active surfactant, the improvement comprising the presence in said composition of from about 1 to about 12 wt. % of elemental magnesium in the form of a water soluble salt, said percentages based on the total weight of the solids in the composition.

10. In a non-bleaching cleaning composition comprising about 75 to 80 wt. % of sodium carbonate, about 0.1 to 15 wt. % of sodium bicarbonate and an active surfactant comprising an anionic surfactant which is an alkali metal salt of sulfated linear $C_{12}$–$C_{16}$ alcohols ethoxylated with an average of 1 to 12 moles of ethylene oxide per mole of alcohol and is present in an amount of about 4 to 14 wt. %, and a nonionic surfactant which consists of $C_{12}$–C16 linear alcohols ethoxylated with an average of 1 to 12 moles of ethylene oxide per mole of alcohol and is present in an amount of about 2 to 8 wt. %, the improvement comprising the presence in said composition of from about 1 to about 12 wt. % of elemental magnesium in the form of a water soluble salt, said percentages based on the total weight of solids in the composition.

11. The composition of claim 9 wherein said active surfactant comprises an anionic surfactant and a nonionic surfactant.

12. The composition of claim 11 wherein said anionic surfactant is an alkali metal salt of sulfated linear $C_{12}$–$C_{16}$ alcohols ethoxylated with an average of 1 to 12 moles of ethylene oxide per mole of alcohol and is present in an amount of about 4 to 14 wt. %, and said nonionic surfactant consists of $C_{12}$–$C_{16}$ linear alcohols ethoxylated with an average of 1 to 12 moles of ethylene oxide per mole of alcohol and is present in an amount of about 2 to 8 wt. % based on the weight of total solids.

13. The composition of claim 9 in the form of a dry-appearing powder containing about 1 to 12 wt. % of water.

* * * * *